US009929004B2

(12) United States Patent
Ziemba et al.

(10) Patent No.: US 9,929,004 B2
(45) Date of Patent: Mar. 27, 2018

(54) HIGH FREQUENCY, REPETITIVE, COMPACT TOROID-GENERATION FOR RADIATION PRODUCTION

(71) Applicant: Eagle Harbor Technologies, Inc., Seattle, WA (US)

(72) Inventors: Timothy Ziemba, Bainbridge Island, WA (US); Kenneth E. Miller, Seattle, WA (US); John G. Carscadden, Seattle, WA (US); James Prager, Seattle, WA (US); Angus Macnab, Seattle, WA (US)

(73) Assignee: EAGLE HARBOR TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 15/589,533

(22) Filed: May 8, 2017

(65) Prior Publication Data

US 2017/0243731 A1 Aug. 24, 2017

Related U.S. Application Data

(63) Continuation of application No. 14/461,101, filed on Aug. 15, 2014, now Pat. No. 9,655,221.

(60) Provisional application No. 61/867,304, filed on Aug. 19, 2013.

(51) Int. Cl.
*H01J 65/04* (2006.01)
*H05G 2/00* (2006.01)

(52) U.S. Cl.
CPC ..... *H01J 65/048* (2013.01); *H05G 2/003* (2013.01)

(58) Field of Classification Search
USPC ..... 250/493.1, 504 R
See application file for complete search history.

(56) References Cited

U.S. PATENT DOCUMENTS

| | | | |
|---|---|---|---|
| 5,313,481 | A | 5/1994 | Cook et al. |
| 5,321,597 | A | 6/1994 | Alacoque |
| 5,392,043 | A | 2/1995 | Ribner |
| 5,808,504 | A | 9/1998 | Chikai et al. |
| 6,359,542 | B1 | 3/2002 | Widmayer et al. |
| 6,577,135 | B1 | 6/2003 | Matthews et al. |
| 6,741,120 | B1 | 5/2004 | Tan |
| 6,831,377 | B2 | 12/2004 | Yampolsky |

(Continued)

FOREIGN PATENT DOCUMENTS

| | | |
|---|---|---|
| EP | 1515430 | 3/2005 |

OTHER PUBLICATIONS

Bland, M., et al., "A High Power RF Power Supply for High Energy Physics Applications," Proceedings of the Particle Accelerator Conference, Knoxville, TN, May 16-20, 2005, pp. 4018-4020.

(Continued)

*Primary Examiner* — Kiet T Nguyen

(57) ABSTRACT

Systems and methods are discussed to create radiation from one or more compact toroids. Compact toroids can be created from plasma of gases within a confinement chamber using a plurality of coils of various densities of windings. High current pulses can be generated within the coil and switched at high frequencies to repeatedly generate compact toroids within the plasma. The plasma can produce radiation at various wavelengths that is focused toward a target or an intermediate focus.

20 Claims, 16 Drawing Sheets

(56) References Cited

U.S. PATENT DOCUMENTS

| | | | | |
|---|---|---|---|---|
| 6,897,574 | B2 | 5/2005 | Vaysse | |
| 7,061,230 | B2 | 6/2006 | Kleine | |
| 7,180,082 | B1 | 2/2007 | Hassanein | |
| 7,307,375 | B2 | 12/2007 | Smith et al. | |
| 7,319,579 | B2 | 1/2008 | Inoue et al. | |
| 7,492,138 | B2 | 2/2009 | Zhang et al. | |
| 7,605,385 | B2 | 10/2009 | Bauer | |
| 7,901,930 | B2 | 3/2011 | Kuthi et al. | |
| 7,948,185 | B2 | 5/2011 | Smith et al. | |
| 8,093,979 | B2 | 1/2012 | Wilson | |
| 8,115,343 | B2 | 2/2012 | Sanders et al. | |
| 8,143,790 | B2 | 3/2012 | Smith et al. | |
| 8,723,591 | B2 | 5/2014 | Lee | |
| 8,773,184 | B1 | 7/2014 | Petrov | |
| 8,963,377 | B2 | 2/2015 | Ziemba et al. | |
| 9,329,256 | B2 | 5/2016 | Murad | |
| 2001/0008552 | A1 | 7/2001 | Harada | |
| 2003/0169107 | A1 | 9/2003 | LeChevalier | |
| 2006/0210020 | A1 | 9/2006 | Takahashi | |
| 2007/0018504 | A1 | 1/2007 | Wiener et al. | |
| 2007/0115705 | A1 | 5/2007 | Gotzenberger | |
| 2008/0062733 | A1 | 3/2008 | Gay | |
| 2008/0143260 | A1 | 6/2008 | Tuymer | |
| 2008/0198634 | A1 | 8/2008 | Scheel | |
| 2010/0007358 | A1 | 1/2010 | Schaerrer | |
| 2010/0284208 | A1 | 11/2010 | Nguyen | |
| 2011/0026658 | A1* | 2/2011 | Howard | G21B 3/006 376/133 |
| 2012/0155591 | A1 | 6/2012 | Freeze | |
| 2012/0155613 | A1 | 6/2012 | Caiafa | |
| 2013/0113650 | A1 | 5/2013 | Behbahani et al. | |
| 2013/0188764 | A1 | 7/2013 | Seward | |
| 2014/0109886 | A1 | 4/2014 | Singleton et al. | |
| 2014/0146571 | A1 | 5/2014 | Ryoo | |
| 2014/0268968 | A1 | 9/2014 | Richardson | |
| 2014/0354343 | A1 | 12/2014 | Ziemba et al. | |
| 2015/0028932 | A1 | 1/2015 | Ziemba et al. | |
| 2015/0076372 | A1 | 3/2015 | Ziemba et al. | |
| 2015/0130525 | A1 | 5/2015 | Miller et al. | |
| 2015/0256086 | A1 | 9/2015 | Miller et al. | |
| 2015/0303914 | A1 | 10/2015 | Ziemba et al. | |
| 2015/0318846 | A1 | 11/2015 | Prager et al. | |

OTHER PUBLICATIONS

In, Y., et al., "On the roles of direct feedback and error field correction in stabilizing resistive-wall modes," Nuclear Fusion, 2010, retrieved from p://stacks.iop.org/NF/50/042001 on Apr. 12, 2012, vol. 50, No. 4, 5 pages.

Kim, J., et al., "High Voltage Pulsed Power Supply Using IGBT Stacks," IEEE Transactions on Dielectrics and Electrical Insulation, Aug. 2007, vol. 14, No. 4, 921-926.

Locher, R., "Introduction to Power MOSFETs and their Applications (Application Note 558)," Fairchild Semiconductor, Oct. 1998, 15 pages.

Locher, R., et al., "Use of BiMOSEFTs in Modern Radar Transmitters," IEEE International Conference on Power Electronics and Drive Systems, Indonesia, 2001, pp. 776-782.

Reass, W., et al., "Progress Towards a 20 KV, 2 KA Plasma Source Ion Implantation Modulator for Automotive Production of Diamond Film on Aluminum," submitted to 22nd International Power Symposium, Boca Raton, FL, Jun. 24-27, 1996, 6 pages.

Scoville, J., et al., "The Resistive Wall Mode Feedback Control System on DII-D," IEEE/NPSS 18th Symposium Fusion Engineering, Albuquerque, NM, Oct. 25-29, 1999, General Atomics Report GAA23256, Nov. 1999, 7 pages.

Zavadtsev, D., et al., "Compact Electron Linear Accelerator RELUS-5 for Radiation Technology Application," 10th European Particle Accelerator Conference, Edinburgh, UK, Jun. 26-30, 2006, 3 pages.

International Search Report and Written Opinion dated Sep. 15, 2014 as received in PCT Application No. PCT/US2014/04029.

International Search Report and Written Opinion dated Feb. 20, 2015 in related PCT application No. PCT/US2014/065832 (14 pages).

A. Starikovskiy and N. Aleksandrov, "Plasma-assited ignition and combustion," Progress in Energy and Combustion Science, 39, 1, Feb. 2013, pp. 61-110.

Gaudet, J., et al, "Research Issues Developing Compact Pulsed Power for High Peak Power Applications on Mobile Platforms," Proc. IEEE, 92, 7, Jun. 2004, pp. 1144-1165.

D.A. Singleton et al. "Compact Pulsed-Power Systems for Transient Plasma Ignition," IEEE Trans. Plasma Sci., 37, 12, Aug. 2009 pp. 2275-2279.

Wang, F., "Compact High Repetition Rate Pseudospark Pulse Generator," IEEE Trans. Plasma Sci., 33, 4, Aug. 2005 pp. 1177-1181.

Singleton, D. R., "Low Energy Compact Power Modulators for Transient Plasma Ignition," IEEE Trans. Dielectr. Electr. Insul., 18, 4, Aug. 2011, pp. 1084-1090.

Roa, X., et al., "Combustion Dynamics of Plasma-Enhansed Premixed and Nonpremixed Flames," IEEE Tans. Plasma Sci., 38, 12, Nov. 2010 pp. 3265-3271.

Pokryvailo, A., et al, "A 1KW Pulsed Corona System for Pollution Control Applications." 14th IEEE International Pulsed Power Confernce, Dallas TX, USA, Jun. 15-18, 2003.

Pokryvailo, A., et al, "High-Power Pulsed Corona for Treatment of Pollutants in Heterogenous Media," IEEE Trans. Plasma Sci., 34, 5, Oct. 2006, pp. 1731-1743.

Dammertz, G., et al, "Development of Multimegawatt Gyrotrons for Fusion Plasma Heating and Current Drive," IEEE Trans. Elec. Devices., 52, 5, Apr. 2005, pp. 808-817.

Zhu, A., et al, "High Voltage pulser with a fast fall-time for plasma immersion ion implantation," Review Sci Inst., 82, 045102, Apr. 2011.

Sanders, J., et al, "Scalable, Compact, Nanosecond Pulse Generation with a High Repetition Rate for Biomedical Applications, Requiring Intense Electric Fields," Pulsed Power Conference, 2009, PPC '09. IEEE, Washington, DC, Jun. 28-Jul. 2, 2009.

Schamiloglu, E., et al., "Scanning the Techology: Modern Pulsed Power: Charlie Martin and Beyond," Proc. IEEE, 92, 7, Jun. 2004, pp. 1014-1020.

Garwin, Richard, "Pulsed Power Peer Review Committee Report," Sandia National Report, SAND2000-2515, Oct. 2000.

International Search Report and Written Opinion dated Oct. 6, 2015 in related PCT application No. PCT/US2015/040204 (15 pages).

International Search Report and Written Opinion dated Jul. 14, 2015 in related PCT application No. PCT/US15/18349 (11 pages).

US Office Action in U.S. Appl. No. 14/461,101, dated Oct. 7, 2016, 6 pgs.

US Notice of Allowance in U.S. Appl. No. 14/461,101, dated Mar. 22, 2017, 7 pgs.

* cited by examiner

Section A-A

HIGH FREQUENCY, REPETITIVE, COMPACT TOROID-GENERATION FOR RADIATION PRODUCTION

FIELD

Embodiments described herein are directed toward high frequency, repetitive, compact toroid generation for radiation production.

SUMMARY

A radiation source is provided that includes a gas source; a confinement tube coupled with the gas source and configured to contain gas introduced into the confinement tube from the gas source; and a resonant inductor having a plurality of windings around the confinement tube that is configured to ionize gas disposed within the confinement tube, generate a compact toroid within the ionized gas, and produce radiation from the compact toroid.

In some embodiments, the resonant inductor may include a plurality of windings that is non-uniform in the diameter of the plurality of windings along at least one dimension. In some embodiments, the resonant inductor may include a plurality of windings that is non-uniform in the number of the plurality of windings along at least one dimension. In some embodiments, the resonant inductor may include an imaging chamber, wherein the resonant inductor is configured to direct compact toroids from the containment chamber to the imaging chamber.

In some embodiments, the resonant inductor may include a coil having one or more windings, and the radiation source may include switching circuitry electrically coupled with the resonant inductor and configured to generate a high current pulse within the coil of the resonant inductor; and switch the high current pulse at high frequencies. In some embodiments, the high frequency comprises a frequency greater than 1 MHz. In some embodiments, the resonant inductor can be driven with a current over 500 amps.

In some embodiments, the resonant inductor may include an outer inductor coil.

A method is provided that includes ionizing a gas within a confinement chamber; generating a plurality of compact toroids from the ionized gas using a resonant inductor; and focusing radiation produced by each of the plurality of compact toroids to a target or an intermediate focus.

In some embodiments, the radiation produced by each of the compact toroids may include ultraviolet radiation, extreme ultraviolet radiation, X-ray radiation, and/or soft X-ray radiation. In some embodiments, the gas may include a Nobel noble gas, xenon, hydrogen, helium, argon, neon, krypton, tin, stannane ($SnH_4$), fluorine, hydrogen chloride, carbon tetrafluoride, lithium, hydrogen sulfide, mercury, gallium, indium, cesium, potassium, astatine, and/or radon.

In some embodiments, the resonant inductor includes a plurality of windings that is non-uniform in the number of the plurality of windings along at least one dimension. In some embodiments, the resonant inductor comprises a plurality of windings that is non-uniform in the diameter of the plurality of windings along at least one dimension.

In some embodiments, the generating a compact toroid using the resonant inductor may include generating a high current pulse within coils of the resonant inductor; and switching the high current pulse at high frequencies.

A method is provide that includes introducing gas into a confinement chamber; ionizing the gas within the confinement chamber; generating a first compact toroid from the ionized gas; focusing radiation produced by the first plurality of compact toroids to a target; reionizing the gas within the confinement chamber; generating a second compact toroid from the ionized gas; and focusing radiation produced by the second plurality of compact toroids to the target.

In some embodiments, the method may include introducing gas into the confinement chamber prior to reionizing the gas within the confinement chamber. In some embodiments, the first compact toroid is generated using a resonant inductor. In some embodiments, the radiation produced by the first compact toroid and the radiation produced by the second compact toroid may include ultraviolet radiation, extreme ultraviolet radiation, X-ray radiation, and/or soft X-ray radiation.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Systems and methods are disclosed for the production of radiation from a volume of plasma that is typically referred to as a compact toroid. Radiation can be produced in various wavelength bands such as, for example, extreme ultraviolet (EUV) (e.g., 10-124 nm), vacuum ultraviolet (VUV) radiation (e.g., 100-200 nm), ultraviolet radiation (e.g., 10-400 nm), soft X-ray radiation (0.1-0.2 nm), X-ray radiation (e.g., 0.01-10 nm), etc. The volume of plasma may comprise a compact toroid, compact poloid, spheroid, or any other geometric volume. The radiation can be produced and directed toward a target and/or an intermediate focus where the radiation may be applied to any number of applications such as, for example, lithography, microscopy, spectroscopy, lasers, light sources, metrology, etc.

As used herein the term "compact toroid" can include all compact toroids and/or all compact poloids. Thus, any reference to a compact toroid extends also to a compact poloid.

A compact toroid is a class of a toroidal plasma configuration containing closed magnetic field line geometries. A compact toroid can be self-stable and can contain toroidal magnetic field components, which can act as a confining mechanism for the hot plasma. A compact toroid can be created using a high voltage capacitor bank coupled to either an electromagnet or electrode system, which creates the plasma and magnetic topology. In some embodiments, an additional bias or magnetic field ($B_0$) can be imposed by a secondary set of electromagnetics. Electric currents driven in the plasma can produce a magnetic structure, or compact toroid, which confines the enclosed plasma and provides magnetic isolation of the structure from a vacuum wall.

The plasma can be ionized from any type of material such as, for example, noble gas, xenon, hydrogen, helium, neon, krypton, radon, argon, tin, stannane ($SnH_4$), fluorine, hydrogen chloride, carbon tetrafluoride, lithium, hydrogen sulfide, mercury, gallium, indium, cesium, potassium, astatine, or any combination thereof, etc. The material may include solid, liquid or gaseous material.

Some embodiments described herein are directed toward a radiation plasma source that creates one or more high density, compact toroid plasma at high repetition frequency by directly driving a resonant network in which the inductor can be coupled (e.g., directly coupled) to the source plasma to repeatedly produce multiple high density compact toroids. This may be accomplished by using the resonant inductor winding as a multiple turn coil wound around a dielectric confinement cylinder, which can effectively transformer couple to the source material to create the plasma and magnetic compact toroid configuration.

Figure 1C:
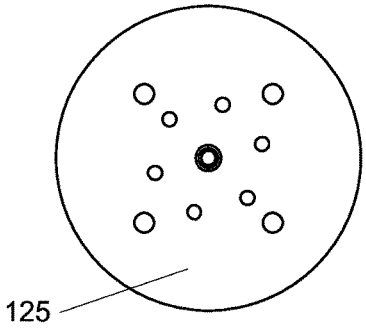
FIG. 1C illustrates a top view of a resonant inductor apparatus according to some embodiments described herein.
Figure 1A:
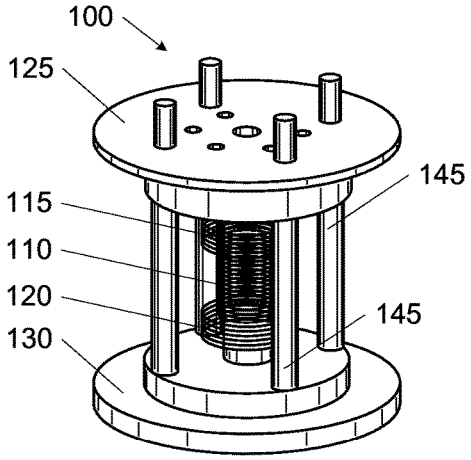
FIG. 1A illustrates a perspective view of an example resonant inductor apparatus according to some embodiments described herein.

FIG. 1A illustrates a perspective view of a resonant inductor apparatus 100 according to some embodiments described herein. The resonant inductor apparatus 100 may include an inductor coil 105 comprising a central resonant inductor 110 between a first resonant inductor 115 and a second resonant inductor 120. The resonant inductor 110, the first resonant inductor 115, and the second resonant inductor 120 may be wrapped around a confinement tube 135, which may be made from quartz, a dielectric, or some other material. The confinement tube may define a confinement chamber within the confinement tube 135. The diameter and length of the confinement tube 135, for example, can be properly scaled to produce a plasma volume, after compact toroid creation, of several cubic millimeters.

For example, the confinement tube 135 may have a diameter of 0.25 cm, 0.5 cm, 0.75 cm, 1.0 cm, 1.25 cm, 1.5 cm, 1.75 cm, 2.0 cm, 2.25 cm, 2.5 cm, 2.75 cm, etc. As another example, the confinement tube 135 may have a length of 0.25 cm, 0.5 cm, 0.75 cm, 1.0 cm, 1.25 cm, 1.5 cm, 1.75 cm, 2.0 cm, 2.25 cm, 2.5 cm, 2.75 cm, 3.0 cm, 3.25 cm, 3.5 cm, 3.75 cm, 4.0 cm, etc.

As shown in FIG. 1A, the first resonant inductor 115 and the second resonant inductor 120 may have more windings than the central resonant inductor 110. Also, as shown, the first resonant inductor 115 and the second resonant inductor 120 are disposed at the ends of the confinement tube 135. The additional windings in the first resonant inductor 115 and the second resonant inductor 120 can produce a greater magnetic field at the ends of the confinement tube 135, which can help confine the compact toroid within the central part of the confinement tube 135. Various different configurations of windings can be used without limitation.

Figure 1B:
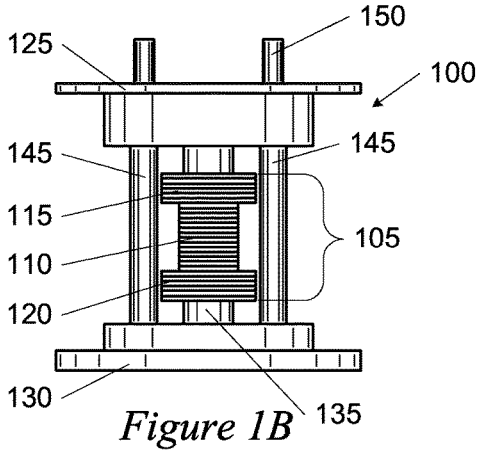
FIG. 1B illustrates a side view of a resonant inductor apparatus according to some embodiments described herein.
Figure 1E:
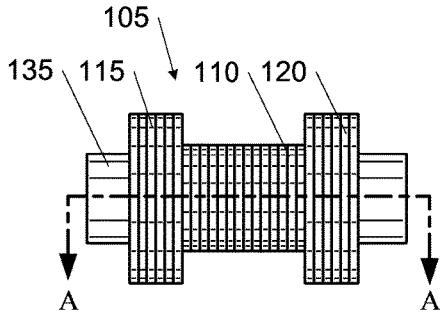
FIG. 1E illustrates a side view of an inductor coil according to some embodiments described herein.
Figure 1D:
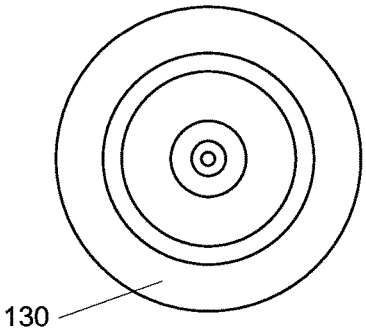
FIG. 1D illustrates a bottom view of a resonant inductor apparatus according to some embodiments described herein.
Figure 1F:
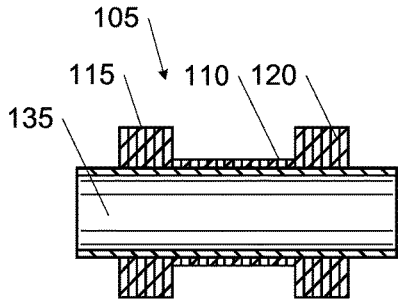
FIG. 1F illustrates a cutaway side view of an inductor coil according to some embodiments described herein.

FIG. 1B illustrates a side view of the resonant inductor apparatus 100 according to some embodiments described herein. FIG. 1C illustrates a top view of the resonant inductor apparatus 100 according to some embodiments described herein. FIG. 1D illustrates a bottom view the resonant inductor apparatus 100 according to some embodiments described herein. FIG. 1E illustrates a side view of the inductor coil 105 according to some embodiments described herein. FIG. 1F illustrates a cutaway side view of the inductor coil 105 according to some embodiments described herein.

A gas, including any gas described herein can be introduced within confinement tube 135. In some embodiments, the gas may not be a noble gas. An initial bias magnetic field can be created in the confinement tube 135 by running current through the inductor coil 105. This initial bias magnetic field can be created in the axial direction within confinement tube 135 (e.g., parallel with the axis of the confinement tube 135). The gas can be ionized by the resultant electric field produced by the inductor coil 105 and/or by a high powered RF burst from the coils produced from a burst of current introduced into the inductor coil 105. The initial bias magnetic field generated from the inductor coil 105 can induce a bias magnetic field within the plasma, for example, it "freezes in" the bias magnetic field. The magnetic field can then be reversed by introducing an opposite current within the inductor coil 105. This reversal, for example, may cause connection (or reconnection) of the bias magnetic field lines with the imposed reversed magnetic field to create a closed magnetic field geometry such as a toroidal (or polodial) shaped volume of plasma typically referred to as a compact toroid.

In some embodiments, a sinusoidal current can drive the inductor coil 105 and generate a changing magnetic field within the conductive plasma column. The changing magnetic field over time can create an electric field within the plasma, which generates a plasma current in the conducting fluid as described by Faraday's law, $V=-\Delta\varphi/\Delta t$. In response, the plasma current can likewise generate a magnetic field. For compact toroid formation the bias magnetic field can be chosen to have the opposite polarity to the magnetic field generated by the induced plasma current.

The use of the inductor coil 105 for plasma and/or compact toroid creation can produce a high density and/or high temperature plasmas necessary for radiation generation without the use of a laser or electrodes from the source making thermal management more practical. In some embodiments, many different arrangements of coils and confinement cylinders or housings are possible and can be utilized to optimize the creation and positioning of the compact toroids for radiation production.

Figure 2C:
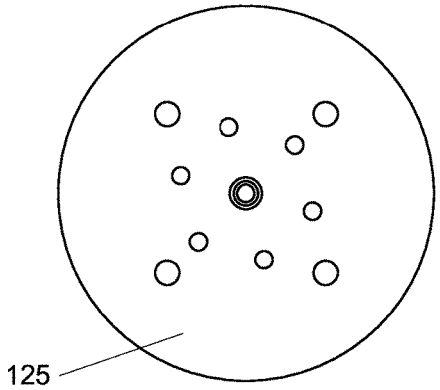
FIG. 2C illustrates a top view of a resonant inductor apparatus according to some embodiments described herein.
Figure 2A:
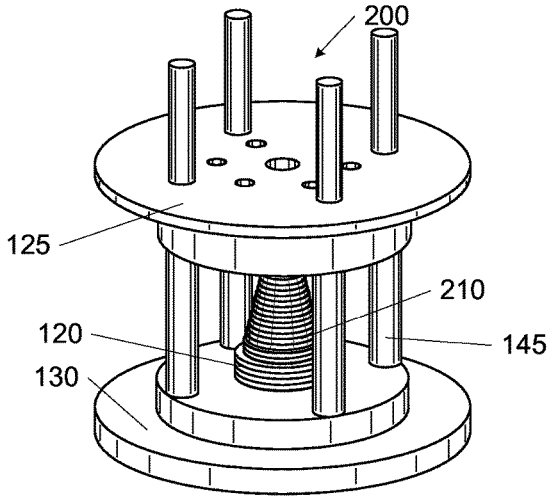
FIG. 2A illustrates a perspective view of an example resonant inductor apparatus according to some embodiments described herein.

FIGS. 2A-2F illustrate another example of a resonant inductor apparatus 200 that includes a conical or tapered inductor coil 205 geometry. FIG. 2A illustrates a perspective view of an example resonant inductor apparatus 200 with a conical or tapered inductor coil 205 and a corresponding tapered confinement tube 235 according to some embodiments described herein. In this embodiment and as shown in the figures, the central resonant inductor 210 may have a tapered shape such as, for example, where the diameter of the coil is greater near the second resonant inductor 120 and small near the first resonant inductor 115. Moving from the second resonant inductor 120 toward the first resonant inductor 120, for example, each successive coil may have a diameter less than the previous coil.

Figure 7:
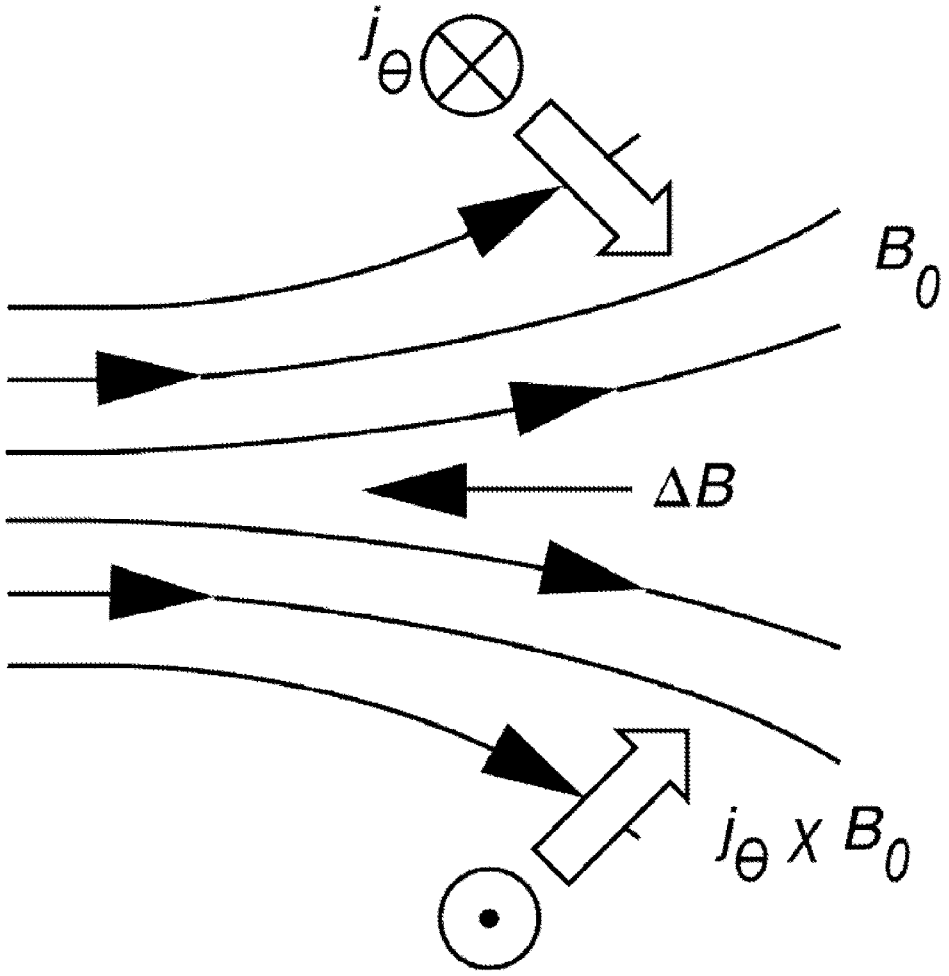
FIG. 7 illustrates an example of a magnetic profile and plasma current and resulting Lorentz force.

In some embodiments, the resonant inductor apparatus 200 can be used, for example, to preferentially accelerate the compact toroids out of the source by tailoring the magnetic field geometry of the system during compact toroid creation. For example, the tapered coil geometry of the central inductor coil 210 will result in the magnetic field profile with a radial component as shown in FIG. 7. Acceleration of the plasma is direct consequence of the Lorentz force, which is produced by the radial component of the magnetic field and plasma current as described by Faraday's Law. The direction of the Lorentz force on the plasma is shown as the bold arrows in FIG. 7 and is directed inward toward the center of the confinement tube 235 and/or along confinement tube 135 axis producing a higher on axis plasma density and accelerating the plasma as shown in FIG. 9D.

Figure 2B:
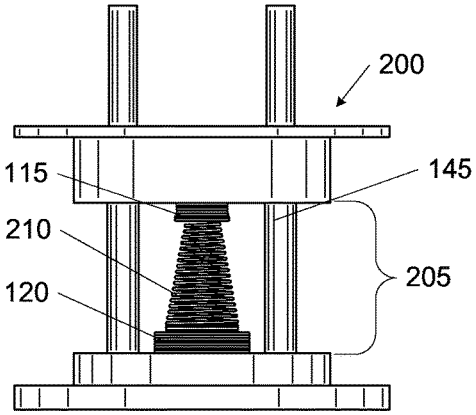
FIG. 2B illustrates a side view of a resonant inductor apparatus according to some embodiments described herein.
Figure 2E:
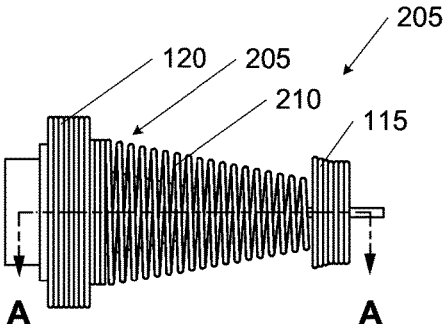
FIG. 2E illustrates a side view of an inductor coil according to some embodiments described herein.
Figure 2D:
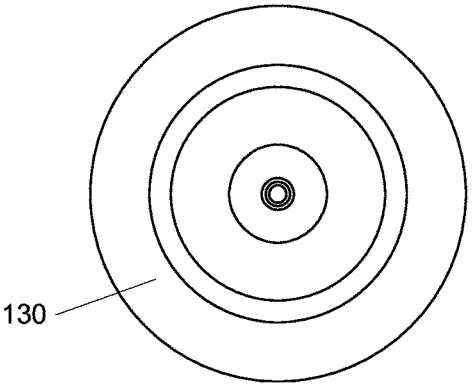
FIG. 2D illustrates a bottom view of a resonant inductor apparatus according to some embodiments described herein.
Figure 2F:
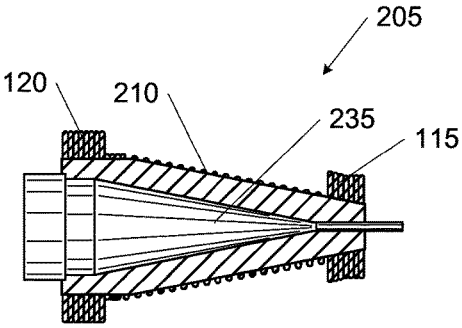
FIG. 2F illustrates a cutaway side view of an inductor coil according to some embodiments described herein.

FIG. 2B illustrates a side view of the resonant inductor apparatus 200 with a conical or tapered inductor coil according to some embodiments described herein. FIG. 2C illustrates a top view of the resonant inductor apparatus 200 with a conical or tapered inductor coil 205 according to some embodiments described herein. FIG. 2D illustrates a bottom view the resonant inductor apparatus 200 with a conical or tapered inductor coil 205 according to some embodiments described herein. FIG. 2E illustrates a side view of the conical or tapered inductor coil 205 according to some embodiments described herein. FIG. 2F illustrates a cutaway side view of the conical or tapered inductor coil 205 according to some embodiments described herein.

Figure 3A:
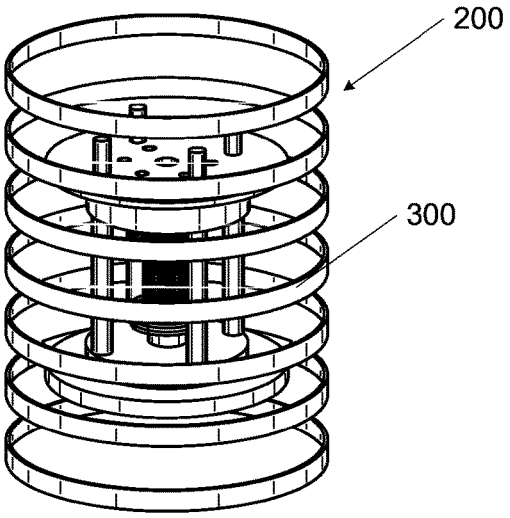
FIG. 3A illustrates a perspective view of a resonant inductor apparatus with an outer inductive coil according to some embodiments described herein.
Figure 3B:
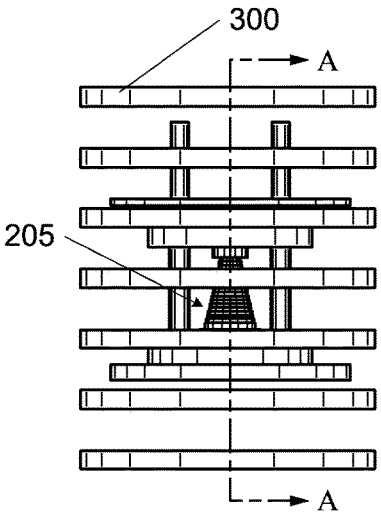
FIG. 3B illustrates a side view of a resonant inductor apparatus with an outer inductive coil according to some embodiments described herein.
Figure 3C:
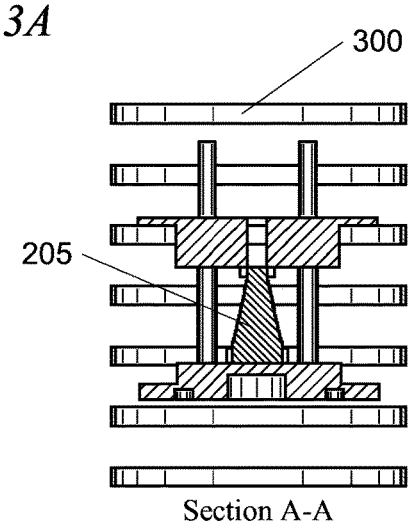
FIG. 3C illustrates a cutaway side view of a resonant inductor apparatus with an outer inductive coil according to some embodiments described herein.

FIG. 3A illustrates a perspective view of a resonant inductor apparatus 200 surrounded by an outer inductive coil 300 according to some embodiments described herein. FIG. 3B illustrates a side view and FIG. 3C illustrates a cutaway side view of the resonant inductor apparatus 200 with the outer inductive coil 300 according to some embodiments described herein.

In some embodiments, the outer inductive coil 300 can be utilized to provide an initial bias magnetic field in the source gas prior to plasma creation. In some embodiments, the magnetic field geometry produced by the outer inductive coil 300 and/or the magnetic field produced by the inductor coil (e.g., the central resonant inductor 110, the first resonant inductor 115, and/or the second resonant inductor 120) can be designed to optimize compact toroid creation and/or to position the compact toroid in a location that is optimum for radiation production, collection and/or imaging.

The resonant network, for example, can include any type of resonant network such as, for example, any of the typical forms with series and/or parallel RLC components. The resonant network can be driven by a variety of topologies including a half-bridge or a full bridge.

Figure 4:
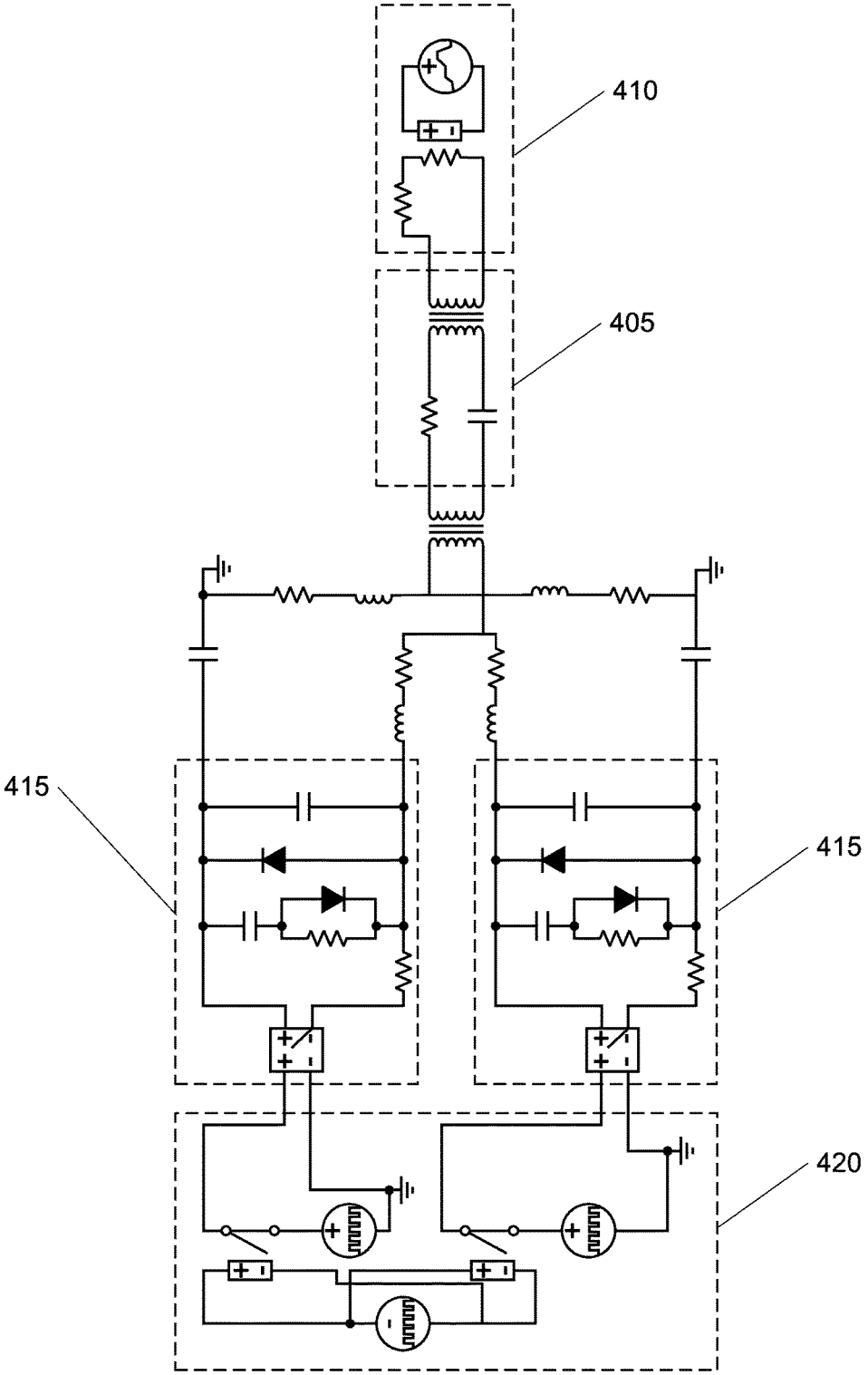
FIG. 4 illustrates an example of a half-bridge circuit topology for directly driving the resonant network to energize the plasma.

FIG. 4 illustrates an example circuit configuration of a half-bridge series resonant converter where the resonant inductor is shown as the primary of a transformer 405 and the plasma created within the resonant inductor apparatus is the secondary of the transformer 410. The ring-up of the inductor current or voltage profile in time to a steady state value may be a function of the qualify factor (Q) of the turned resonant network, where Q can be defined as a ratio of the energy stored per cycle to the energy dissipated per cycle such that the signal amplitude remains constant at the resonant frequency. For series resonant networks as shown in 405, Q may also be defined as the ratio of the reactive impedance of the network to the real impedance of the circuit. One or more high power, high frequency power supplies 415 can be used along with a power supply controller 420 can be used.

The power supply 415 may include, for example, an IGBT power supply that can provide high power at high frequencies. In some embodiments, the power supply can switch at various frequencies such as, for example, 250 kHz, 500 kHz, 750 kHz, 1 MHz, 1.5 MHz, 2.5 MHz, 3.0 MHz, 4.0 MHz, 5.0 MHz, 6.0 MHz, 7.0 MHz, 8.0 MHz, 9.0 MHz, 10.0 MHz, 20 MHz, 50 MHz, 100 MHz, etc. In some embodiments, the power supply can be driven with a current of over 500 amps, such as, for example, 750 amps, 1,000 amps, 1,500 amps, 2,000 amps, 2,500 amps, 3,000 amps, 3,500 amps, 4,000 amps, 4,500 amps, 5,000 amps, 10,000 amps, 20,000 amps, 30,000 amps, 40,000 amps, 50,000 amps, etc.

In some embodiments, a half or a full bridge resonant power converter topology can be coupled to the resonant coil directly or to the primary of a transformer with the secondary connected to the resonant coil as shown in FIG. 4. Resonant power converters contain L-C networks such as, for example, series, parallel and/or LCC tank networks. In some embodiments, the resonant power converter can be controlled to allow for accurate timing for plasma creation and acceleration. In some embodiments, the resonant power converter may be power efficient due to the utilization of solid-state components. In some embodiments, the resonant converter may maintain the stored energy in the resonant network on each resonant cycle that can be used to repetitively produce compact toroids increasing efficiency over single shot or ringing LC networks. In some embodiments, the resonant power converter can be controlled in real time to maximize the power delivered to the plasma.

Figure 5:
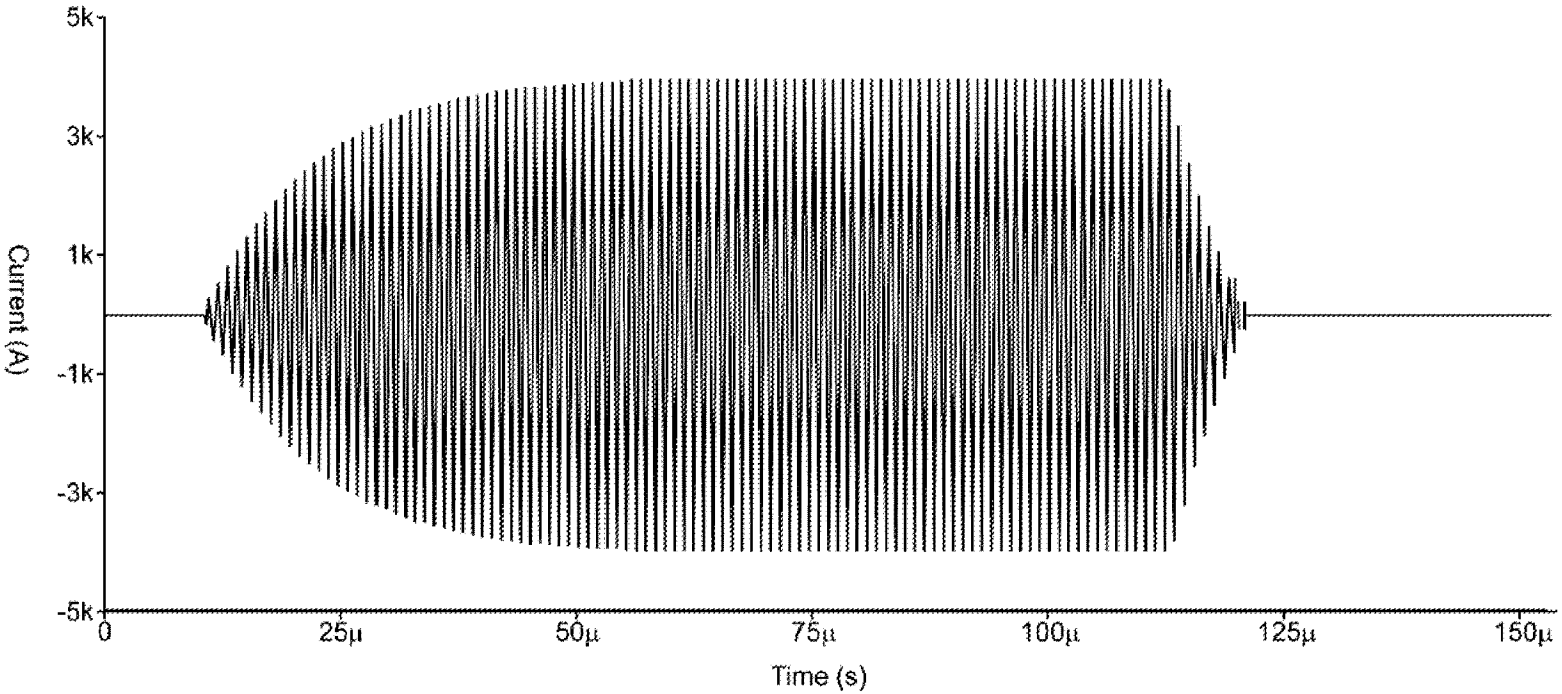
FIG. 5 illustrates an example of the resonant inductor current profile as a function of time when no plasma is present.
Figure 6:
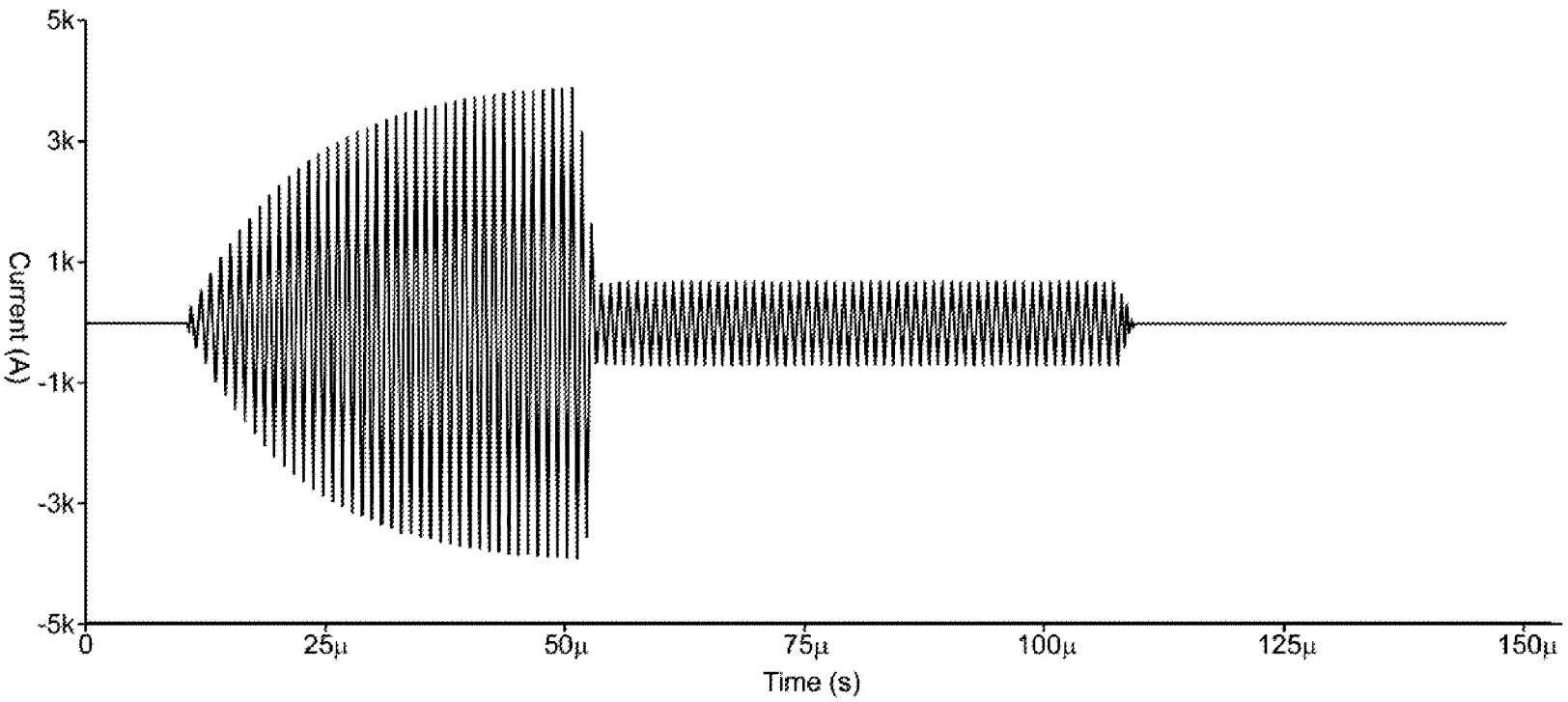
FIG. 6 illustrates an example of the resonant inductor current profile as a function of time when plasma is present.

FIG. 5 is a graph of inductor current over time when no plasma is created. FIG. 6 is a graph of inductor current over time when plasma is created, and the circuit is delivering power to the plasma via transformer coupling with the inductor coil 105 (or inductor coil 205). The repetitive production of compact toroids is accomplished by driving the electrical circuit at high power and high current, for example, using IGBT power supplies, where typical peak power levels are in excess of several thousand or several hundred thousand watts with coil currents over several hundred amps or several thousand amps. The resultant sinusoidal current in the resonant inductor generates a changing magnetic field within the conductive plasma. The change in magnetic field as a function of time creates an electric field within the plasma causing a plasma current to be generated in the conducting fluid as described by Faraday's law, $V=-\Delta\varphi/\Delta t$. In the absence of an existing bias magnetic field within the plasma column, the generated plasma current will form a theta pinch configuration. A theta pinch will also be created if the magnitude of the magnetic field created is less than the magnitude of the bias magnetic field. For compact toroid formation the bias magnetic field can be chosen to have opposite polarity to the magnetic field generated by the induced plasma current so that upon plasma current generation a magnetically confined plasmoid can be produced. The plasmoid can contain any arrangement of magnetic field components in the toroidal and/or polodial directions leading to configurations known as compact toroids, compact poloids, spheromaks, field reversed configurations or particle rings.

The bias magnetic field may be created by an additional set of electro or permanent magnets as shown in FIG. 3. In the case of high frequency sinusoidal resonant inductor current, the bias magnetic field from the previous half cycle period can be generated from the previous cycle. In this case, the magnetic field will still be present in the plasma if resonant frequency is faster than the characteristic resistive decay time for magnetic flux in the plasma, which may be a function of the plasma size and its resistivity. Typical resistive decay times, for example, can range from 500 ns to 1 ms, which may allow for resonant frequencies of 2 MHz for compact toroid creation. Various other decay times may occur, therefore, various other resonant frequencies can be used such as, for example, 250 kHz, 500 kHz, 750 kHz, 1 MHz, 1.5 MHz, 2.5 MHz, 3.0 MHz, 4.0 MHz, 5.0 MHz, 6.0 MHz, 7.0 MHz, 8.0 MHz, 9.0 MHz, 10.0 MHz, 20 MHz, 50 MHz, 100 MHz, etc. In some embodiments, any frequency up to 50 MHz may be used. Since the sinusoidal resonant current experiences a zero crossing at each half cycle the previous cycle's magnetic field will be of opposite polarity. A secondary condition for compact toroid creation may include that the magnitude of the induced magnetic field be greater than the magnitude of the bias magnetic field. This condition can be met using the sinusoidal resonant method due to the resistive decay time of the plasma from one cycle to the next. The conditions of plasma compact toroid creation can be adjusted with resonant frequency and plasma size.

In some embodiments, discrete compact toroids can be created at each half period of the sinusoidal waveform of the resonant current or at time steps determined by controlling the pulse characteristics of the power supply. The magnetized quantity of each individual compact toroid may increase particle confinement allowing for extended time for radiation production. The magnetized quantity of the compact toroids may also allow for positioning control and acceleration of the plasma into a chamber where the produced radiation can be focused or imaged.

In some embodiments, position control of the compact toroid can occur utilizing a shaped magnetic topology. For example, the resonant coil windings of the inductor coil 105 and/or inductor coil 205 can be made to produce a high amplitude magnetic field in preferred areas. For example, one or more coils of the first resonant inductor 115 may have a smaller diameter than one or more coils of the second resonant inductor 120. As another example, one or more coils of the first resonant inductor 115 may have a more turns per distance than one or more coils of the second resonant inductor 120. As another example, more current can be applied through the first resonant inductor 115 than the second resonant inductor 120.

The inductor coil can include various coil arrangements such as, for example, those shown in FIGS. 1E, 1F, 2E, and 2F. The magnetic field profile and/or the generated plasma current can apply a force on the compact toroid, which is described by the Lorentz force equation, $F=q(E+v\times B)$. This force may accelerate the compact toroid in a preferred direction allowing for positional control of the plasma volume. This process is shown in FIG. 7, where $j_\theta$ represents the plasma current and $B_0$ represents the instantaneous magnetic field created by the resonant inductor. The resulting $j_\theta\times B_0$ force is directed radially inward and to the right in this example.

FIGS. 8A-8E illustrate a process of creating a compact toroid for radiation production according to some embodiments described herein. Although any geometry may be used for the confinement chamber 800, in this example, a cylindrical confinement chamber 800 is used for axial imaging. Various other confinement chamber geometries and/or configurations may be used.

Figure 8A:
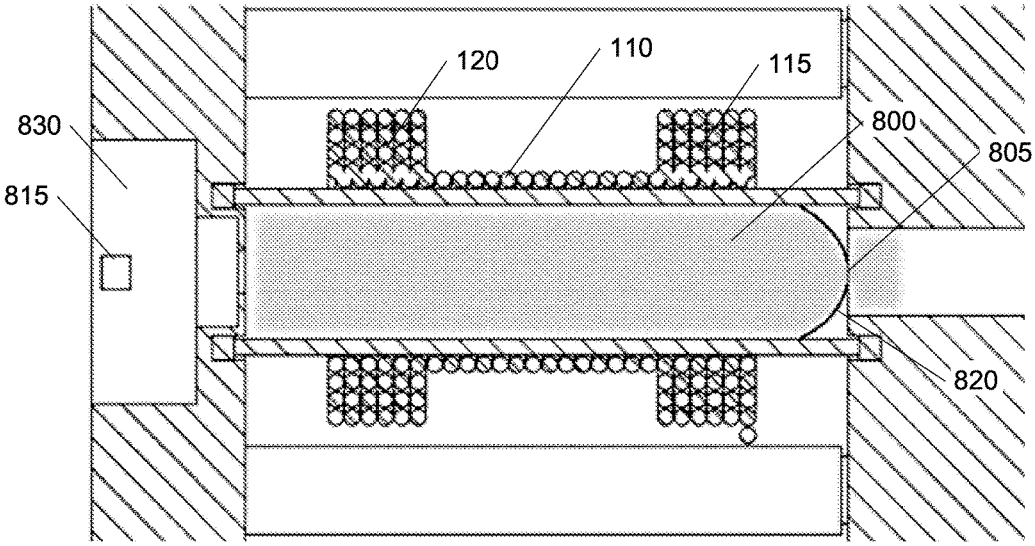
FIG. 8A illustrates an example resonant inductor apparatus during a neutral gas injection phase according to some embodiments described herein.

In FIG. 8A, a gas may be injected into the confinement chamber 800 via valve 805. The gas may include any gas described herein. Valve 805 may include a fast gas puff valve. After waiting a predetermined period of time (e.g., approximately 0.1 ms to 10 ms) to allow for gas to fill the chamber to a predetermined neutral particle density the valve can be closed. Coils of the central resonant inductor 110, the first resonant inductor 115, and the second resonant inductor 120 may surround the confinement chamber 800.

Figure 8B:
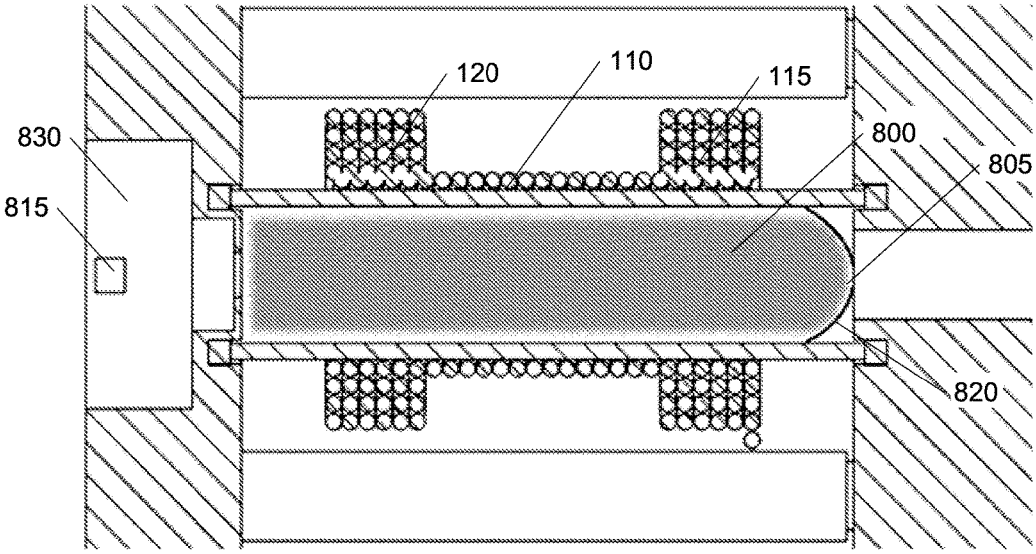
FIG. 8B illustrates an example resonant inductor apparatus during an initial ionization phase according to some embodiments described herein.

Once the valve is closed as shown in FIG. 8B, power can be applied to the inductor coil 105 such as, for example, by switching of the half-bridge circuit. By turning on the power to the inductor coil 105, initial ionization of the gas can occur. In some embodiments, the resonant voltages developed on the inductor may be sufficient to cause initial ionization of the gas for plasma generation. In other embodiments an additional ionization source can be used such as, for example, the inductive coil 300.

Figure 8C:
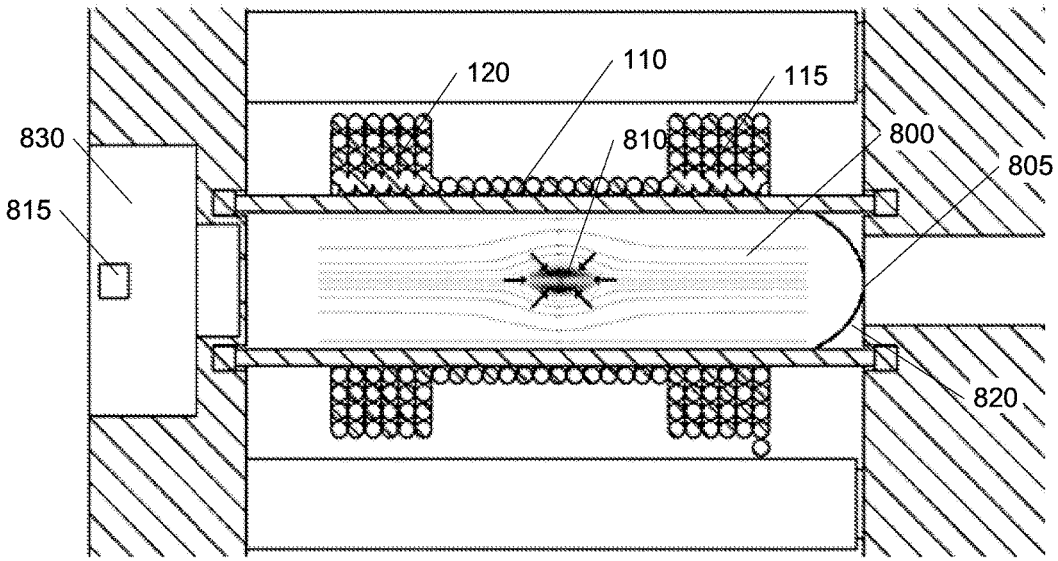
FIG. 8C illustrates an example resonant inductor apparatus during a compact toroid formation phase according to some embodiments described herein.
Figure 8D:
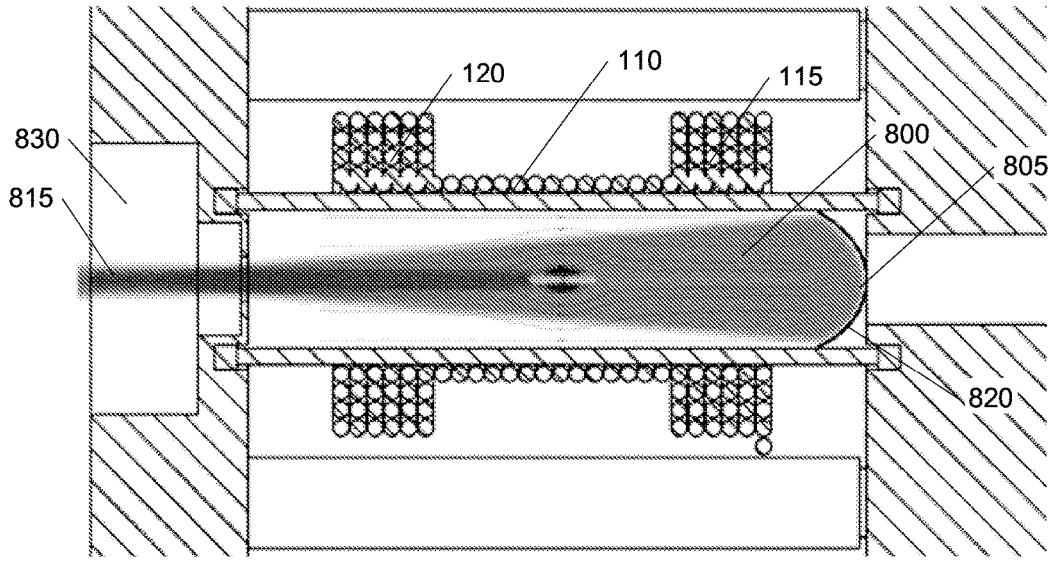
FIG. 8D illustrates an example resonant inductor apparatus during a radiation production phase according to some embodiments described herein.

Once the initial low density plasma is generated though plasma ionization as described above in conjunction with FIG. 8B, compact toroid formation can occur as shown in FIG. 8C. Compact toroid formation may begin with inductive coupling of the inductor coil 105 to the plasma as described above. Enough plasma current can be driven to fully reverse the bias magnetic field, and a compact toroid 810 may be formed within the confinement chamber 800. In some embodiments, the magnetic geometry imposed by the inductor coil 105 such as, for example, those having the first resonant inductor 115 and the second resonant inductor 120, may keep the compact toroid within the confinement chamber 800 such as, for example, within the center of the confinement chamber 800 and/or along the radial center of the confinement chamber 800.

To induce compact toroid formation within the plasma, the inductor coil 105 (or 205) and/or outer coil 300 can be operated at high frequencies and/or high current (or power). In some embodiments, the inductor coil 105 (or 205) and/or outer coil 300 can be driven at frequencies above 250 kHz such as, for example, of 250 kHz, 500 kHz, 750 kHz, 1 MHz, 1.5 MHz, 2.5 MHz, 3.0 MHz, 4.0 MHz, 5.0 MHz, 6.0 MHz, 7.0 MHz, 8.0 MHz, 9.0 MHz, 10.0 MHz, 20 MHz, 50 MHz, 100 MHz, etc. In some embodiments, the inductor coil 105 (or 205) and/or outer coils 300 can be driven with a current of over 500 amps, such as, for example, 750 amps, 1,000 amps, 1,500 amps, 2,000 amps, 2,500 amps, 3,000 amps, 3,500 amps, 4,000 amps, 4,500 amps, 5,000 amps, 10,000 amps, 20,000 amps, 30,000 amps, 40,000 amps, 50,000 amps, etc.

Once the compact toroid is confined within the confinement chamber 800, photons may be produced by the high temperature, dense plasma. These photons can be imaged and/or directed axially out of the end of the confinement chamber 800 toward the intermediate focus 815 or a target located within imaging chamber 830. Various optical elements (e.g., mirrors/reflectors 820) can be positioned within the confinement chamber 800 to focus and/or direct the produced photons. Radiation production can occur continuously or at discrete bursts corresponding to high density compact toroid formation during each half cycle.

Figure 8E:
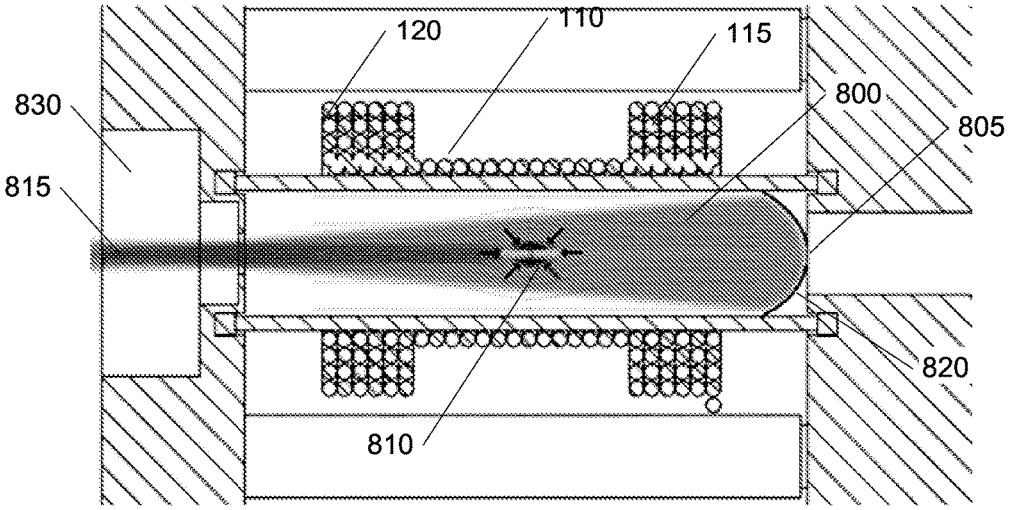
FIG. 8E illustrates an example resonant inductor apparatus during a repeat compact toroid formation and a radiation production phase according to some embodiments described herein.

The creation of compact toroids and/or the creation of radiation may continue as shown in FIG. 8E. After the initial ionization of the source gas or material, the plasma remains at least partially or fully ionized during resonant operation of the circuit as energy is deposited from the circuit into the plasma. This may significantly increase the overall system efficiency as the ionization energy from the neutral gas to plasma formation may not be required for each compact toroid creation. Thus, rather than making single discrete plasma pluses that each require full ionization, some embodiments may leverage the already ionized gas to create another compact toroid and generate radiation without the energy required for full ionization of the neutral gas for each cycle or pulse.

In some embodiments, additional gas may be added to the confinement chamber 800 prior to ionization of the next compact toroid to maintain the proper density of gas within the confinement chamber 800. In some embodiments, gas may be continuously pumped into the confinement chamber 800 as the process is repeated to maintain the proper density of gas within the confinement chamber 800.

Figure 9A:
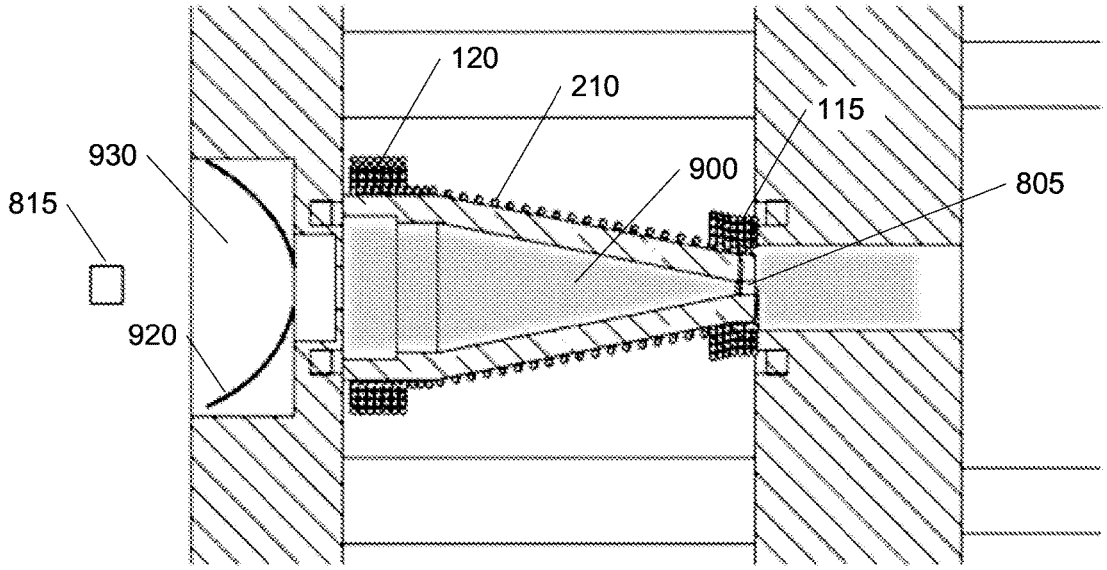
FIG. 9A illustrates an example resonant inductor apparatus during a neutral gas induction phase according to some embodiments described herein.
Figure 9B:
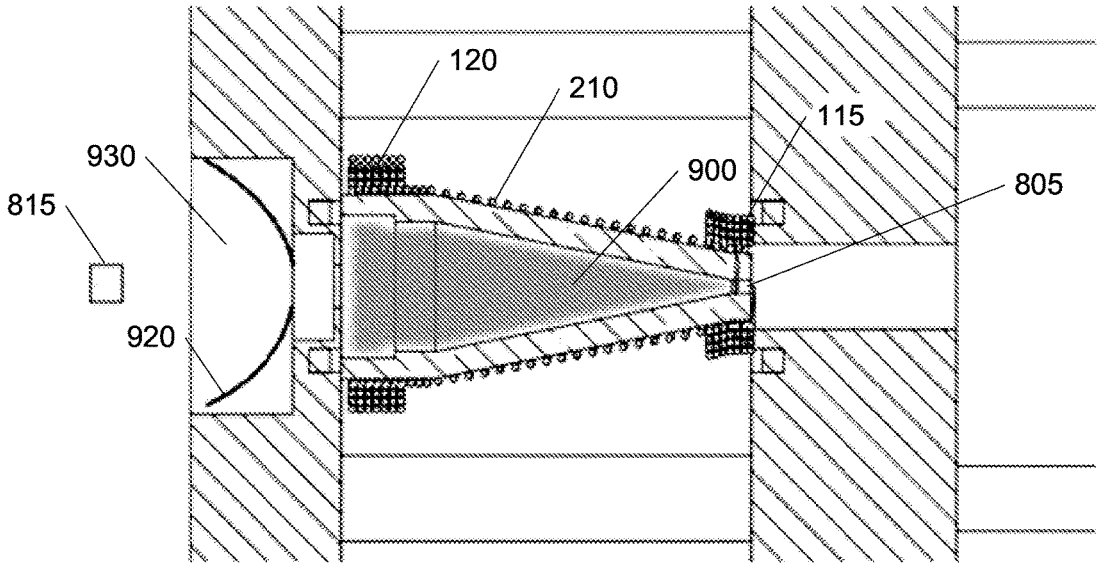
FIG. 9B illustrates an example resonant inductor apparatus during an initial ionization phase according to some embodiments described herein.
Figure 9C:
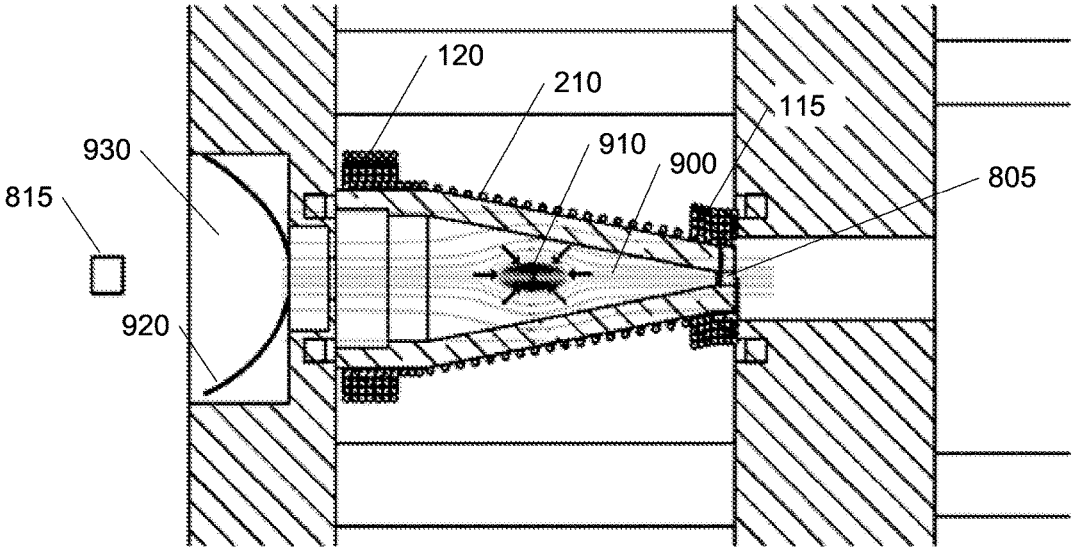
FIG. 9C illustrates an example resonant inductor apparatus during a compact toroid formation phase according to some embodiments described herein.
Figure 9D:
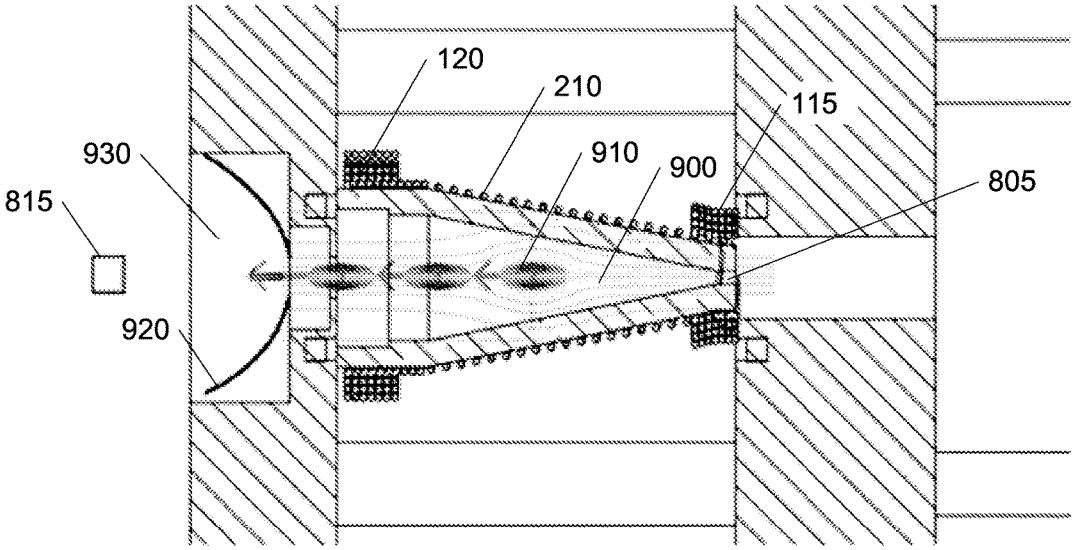
FIG. 9D illustrates an example resonant inductor apparatus during a radiation production phase according to some embodiments described herein.

FIGS. 9A-9E illustrate a process of creating a compact toroid for radiation production according to another embodiment. This can be done, for example, as shown using the inductor coil 205 configuration shown in FIGS. 2A-2E. In this embodiment, for example, the inductor coil 205 and the resulting plasma current, as described above, can accelerate the compact toroid and/or some portion of the residual plasma out of the confinement chamber and into an imaging area. In FIG. 9A, neutral gas is injected into a conical confinement chamber 900 in a manner similar to that discussed above in conjunction with FIG. 8A. In FIGS. 9B and 9C compact toroid formation is accomplished in a similar as discussed above in conjunction with FIG. 8B and FIG. 8C.

Figure 9E:
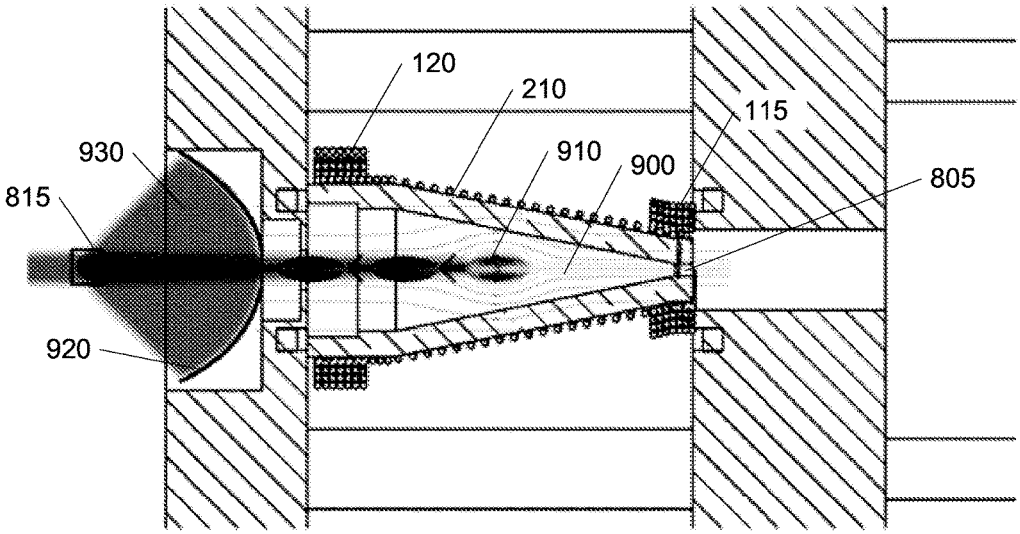
FIG. 9E illustrates an example resonant inductor apparatus during a repeat compact toroid formation and a radiation production phase according to some embodiments described herein.

In this embodiment, however, the conical geometry of the confinement chamber 900 and the shape of the central inductor coil 210 can produce a Lorentz force on the compact toroid that may result in the axial acceleration of the compact toroid as shown in FIG. 9D. In some embodiments, both the shape of the confinement chamber 900 and/or shape of the central inductor coil 210 can be modified to produce the desired position control of the compact toroid. In this example, the compact toroid may be accelerated out of the confinement chamber 900 into an imaging chamber 930. Mirror 920 and/or other imaging optics can be used to reflect and/or refract radiation produced from the compact toroid toward the intermediate focus 815, which may allow more access to all the radiation produced by the plasma (e.g., $4\pi$ sr of the radiation). The process may be repeated with compact toroid formation and acceleration occurring again in the confinement chamber as shown in FIG. 9E. Newly formed compact toroids can be created utilizing the residual plasma/gas remaining from the previous cycle and/or newly injected gas entering the confinement chamber from the gas feed 805.

Figure 10A:
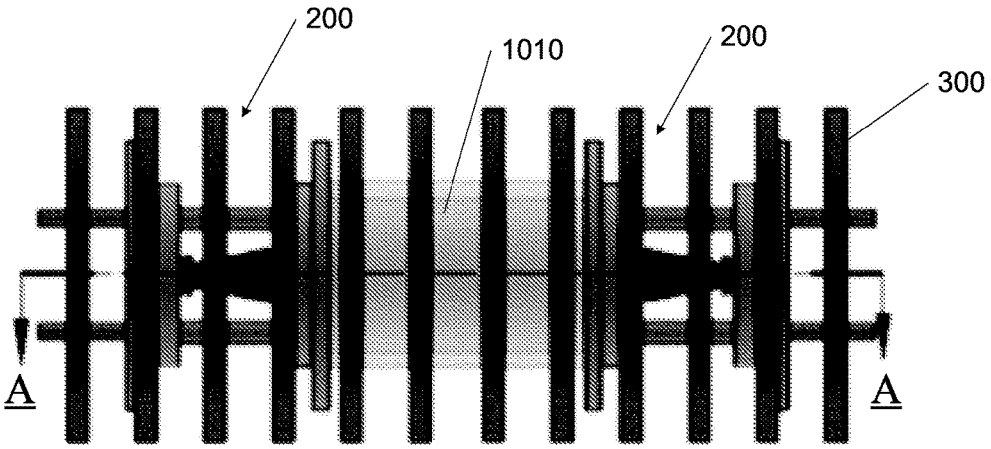
FIG. 10A illustrates a side view of an example two resonant inductor apparatus in a linear arrangement sharing an imaging chamber according to some embodiments described herein.
Figure 10B:
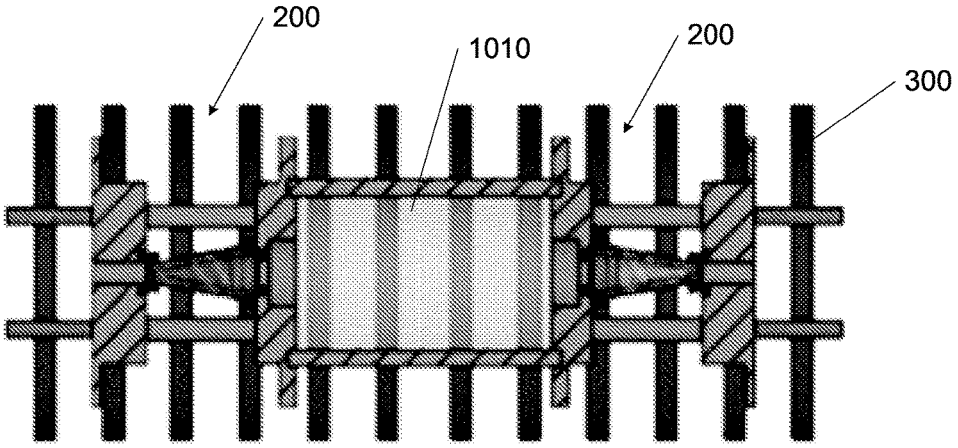
FIG. 10B illustrates a cutaway side view of an example two resonant inductor apparatus in a linear arrangement sharing an imaging chamber according to some embodiments described herein.

FIGS. 10A and 10B illustrate a side view and a side cutaway view of a two resonant inductor apparatus 200 in a linear arrangement sharing an imaging chamber 1010 according to some embodiments described herein. While two resonant inductor apparatus are shown in these figures, any number of resonant inductor apparatus may be used. Two compact toroids may be accelerated and injected into the imagining chamber 1010. In this embodiment, a guide magnetic field can be imposed to control and/or focus the compact toroids into the center of the imagining chamber. In some embodiments, the individual compact toroids can be utilized to collide with each other in the imagine chamber. This collisional process may compress the magnetized compact toroids, which may further increase the plasma temperature and/or density of the compact toroid(s) and result in increased radiation output.

In some embodiments, a target material can be inserted into an imaging chamber (e.g., imaging chamber 1010, imaging chamber 830, and/or imaging chamber 930) to stop the compact toroids at a predetermined location for compression, focusing, and/or imaging. The target material can be designed to optimize the compression of the compact toroid for increased heating of the plasma. The target material can also be designed and used for effective heat removal from the system.

Various embodiments have been disclosed that discuss the generation of radiation, these embodiment can be used, without limitation, with any type of radiation such as for example, extreme ultraviolet (EUV) (e.g., 10-124 nm), vacuum ultraviolet (VUV) radiation (e.g., 100-200 nm), ultraviolet radiation (e.g., 10-400 nm), soft X-ray radiation (0.1-0.2 nm), X-ray radiation (e.g., 0.01-10 nm), etc. In some embodiments, radiation can be produced for light amplification by stimulated emission of radiation (LASER) that may result in overall emission gain and/or the production of a coherent emission beam.

Various embodiments have been disclosed that discuss the creation of compact toroid using inductor coils. Compact toroids may also be created using, for example, a plurality of electrodes.

In some embodiments, one or more DC coils and/or permanent magnets can be used in conjunction with an inductor coil and/or in place of an outer inductor coil.

Figure 11:
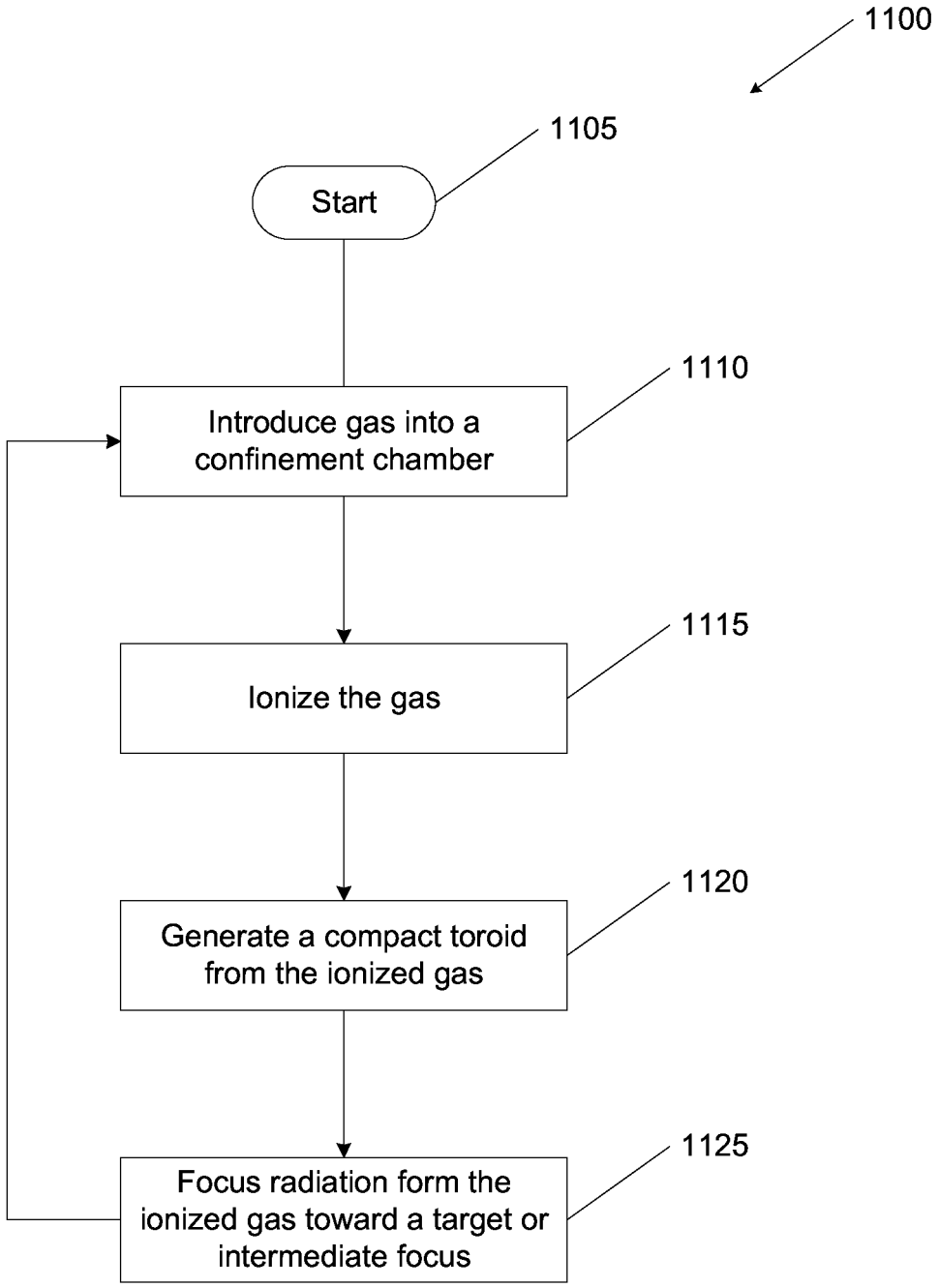
FIG. 11 is a flowchart of an example process for producing radiation using compact toroids according to at least one embodiment described herein.

FIG. 11 is a flowchart of an example process 1100 of producing radiation using compact toroids according to at least one embodiment described herein. One or more steps of the process 1100 may be implemented, in some embodiments, by one or more components of resonant inductor apparatus 100 of FIG. 1 or resonant inductor apparatus 200 of FIG. 2. Although illustrated as discrete blocks, various blocks may be divided into additional blocks, combined into fewer blocks, or eliminated, depending on the desired implementation.

Process 1100 begins at block 1105. At block 1110 gas can be introduced within the confinement chamber. The confinement chamber may include a chamber of any size, dimension or configuration such as, for example, confinement chamber 800 and/or confinement chamber 900. The gas may be introduced from a gas source via a valve such as, for example, a piezoelectric puff valve, an electromagnetic puff valve, a pulse valve, and/or an electromagnetic moving disk puff valve. The gas may be introduced from a gas source, such as, for example, a tank that holds a volume of the gas. The gas may include any gas described herein. In some embodiments, a control system may actuate the valve that is used to actuate the gas into the confinement chamber.

At block 1115 the gas may be ionized using any technique described herein and/or described in the art. For example, the gas may be ionized using magnetic fields produced by an inductor coil such as, for example, the inductor coil 105, the inductor coil 205, and/or the outer inductive coil 300. The control system, for example, can switch power to the inductor coil that produces a sufficient magnetic field to generate plasma within the gas. Various other techniques can be used to ionize the gas such as, for example, using an electromagnetic field applied with a laser, electrodes, and/or a microwave generator.

At block 1120 a compact toroid can be formed within the ionized gas. This can occur, for example, by switching power to the inductor coil at high frequencies and/or high current (or power). For example, the control system may drive a sinusoidal (or nearly sinusoidal periodically changing) current through the inductor coil using a resonant network such as, for example, the resonant network shown in FIG. 400. The sinusoidal current may generate a changing magnetic field within the conductive plasma column. The changing magnetic field can create an electric field within the plasma, which generates a plasma current in the conducting fluid. In response, the plasma current can likewise generate a magnetic field, which can produce a plasmoid such as a compact toroid. The frequency of the sinusoidal current can include any frequency such as, for example, any frequency described herein. The peak current of the sinusoidal current can include any current value such as, for example, any current value described herein.

At block 1120 the radiation produced by the compact toroid can be focused onto a target and/or onto an intermediate focus. In some embodiments, the compact toroid may be moved into an imaging chamber 930 where the radiation produced by the compact toroid can be collected, focused, and/or directed toward a target and/or an intermediate focus.

After block 1120 process 1100 may return to block 1110 where additional gas may be introduced into the confinement chamber. In some embodiments, block 1110 may be skipped for any reason such as, for example, depending on the density, quantity, and/or pressure of gas within the confinement chamber. The control system, for example, via any number of sensors within or without the confinement chamber may determine whether to introduce additional gas into the confinement chamber at block 1110.

Process 1100 may then proceed to block 1115 where the gas may be ionized. In some embodiments, the gas may still be ionized from the previous ionization and/or compact toroid formation steps. Thus, in some embodiments, ionization may not be needed during every cycle. The control system, for example, via any number of sensors within or without the confinement chamber may determine whether the gas is sufficiently ionized. This level of ionization may depend, for example, on the quantity of gas, the type of gas, the size of the chamber, etc.

Process 1100 may cyclically repeat as long as desired. The control system used to control process 1100 may include any type of computational system such as, for example, a computer and/or any other electronic components such as those shown in FIG. 4.

Figure 12:
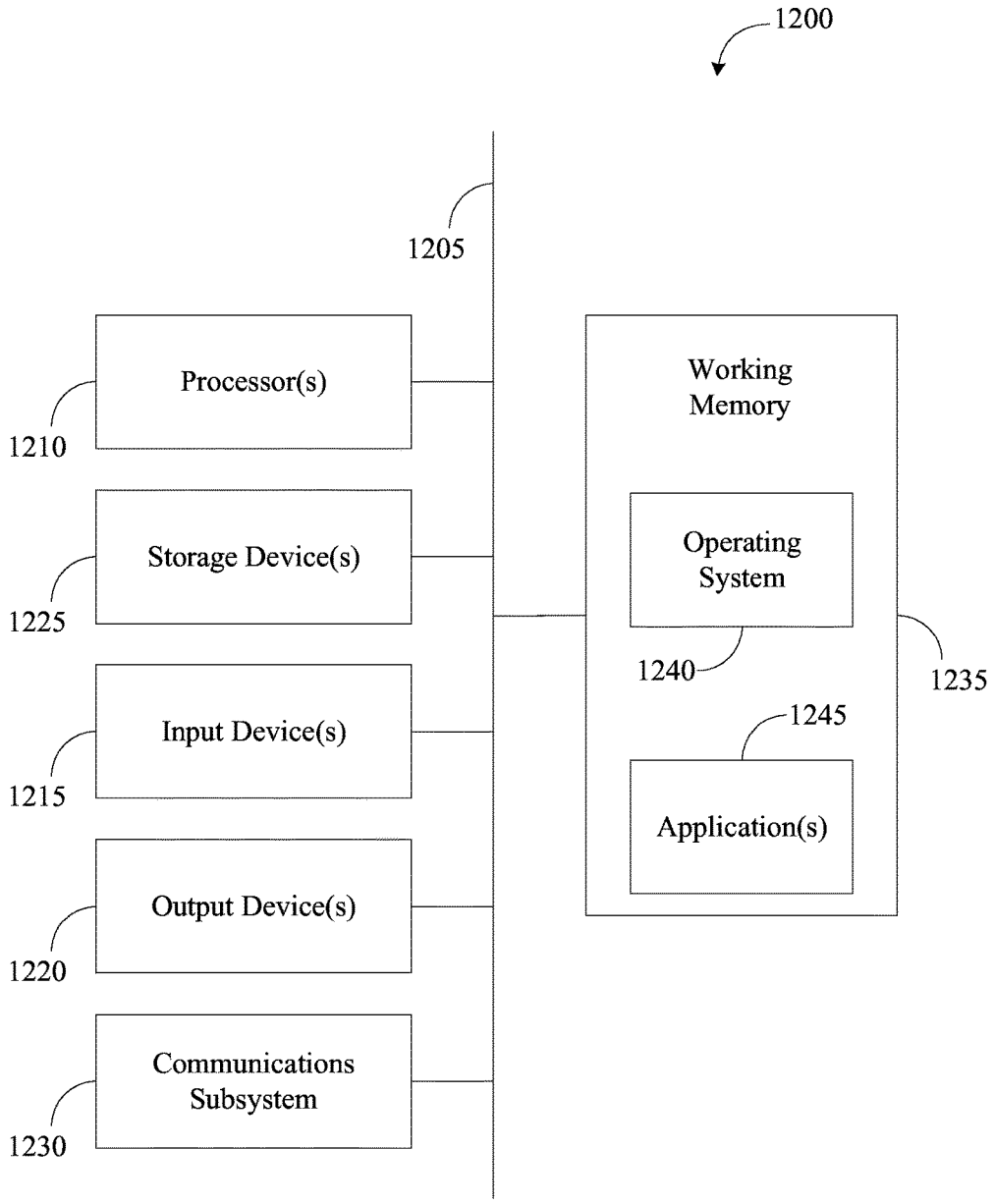
FIG. 12 shows an illustrative computational system for performing functionality to facilitate implementation of embodiments described herein.

A computational system 1200 (or processing unit or control system) illustrated in FIG. 12 can be used to perform and/or control operation of any of the embodiments described herein. For example, the computational system 1200 can be used alone or in conjunction with other components such as the resonant inductor apparatus 100 and/or the resonant inductor apparatus 200. As another example, the computational system 1200 can be used to perform and/or control at least portions of process 1100.

The computational system 1200 may include any or all of the hardware elements shown in the figure and described herein. The computational system 1200 may include hardware elements that can be electrically coupled via a bus 1205 (or may otherwise be in communication, as appropriate). The hardware elements can include one or more processors 1210, including, without limitation, one or more general-purpose processors and/or one or more special-purpose processors (such as digital signal processing chips, graphics acceleration chips, and/or the like); one or more input devices 1215, which can include, without limitation, a mouse, a keyboard, and/or the like; and one or more output devices 1220, which can include, without limitation, a display device, a printer, and/or the like.

The computational system 1200 may further include (and/or be in communication with) one or more storage devices 1225, which can include, without limitation, local and/or network-accessible storage and/or can include, without limitation, a disk drive, a drive array, an optical storage device, a solid-state storage device, such as random access memory ("RAM") and/or read-only memory ("ROM"), which can be programmable, flash-updateable, and/or the like. The computational system 1200 might also include a communications subsystem 1230, which can include, without limitation, a modem, a network card (wireless or wired), an infrared communication device, a wireless communication device, and/or chipset (such as a Bluetooth® device, a 802.6 device, a WiFi device, a WiMAX device, cellular communication facilities, etc.), and/or the like. The communications subsystem 1230 may permit data to be exchanged with a network (such as the network described below, to name one example) and/or any other devices described herein. In many embodiments, the computational system 1200 will further include a working memory 1235, which can include a RAM or ROM device, as described above.

The computational system 1200 also can include software elements, shown as being currently located within the working memory 1235, including an operating system 1240 and/or other code, such as one or more application programs 1245, which may include computer programs of the invention, and/or may be designed to implement methods of the invention and/or configure systems of the invention, as described herein. For example, one or more procedures described with respect to the method(s) discussed above might be implemented as code and/or instructions executable by a computer (and/or a processor within a computer). A set of these instructions and/or codes might be stored on a computer-readable storage medium, such as the storage device(s) 1225 described above.

In some cases, the storage medium might be incorporated within the computational system 1200 or in communication with the computational system 1200. In other embodiments, the storage medium might be separate from the computational system 1200 (e.g., a removable medium, such as a compact disc, etc.), and/or provided in an installation package, such that the storage medium can be used to program a general-purpose computer with the instructions/code stored thereon. These instructions might take the form of executable code, which is executable by the computational system 1200 and/or might take the form of source and/or installable code, which, upon compilation and/or installation on the computational system 1200 (e.g., using any of a variety of generally available compilers, installation programs, compression/decompression utilities, etc.), then takes the form of executable code.

Numerous specific details are set forth herein to provide a thorough understanding of the claimed subject matter. However, those skilled in the art will understand that the claimed subject matter may be practiced without these specific details. In other instances, methods, apparatus, or systems that would be known by one of ordinary skill have not been described in detail so as not to obscure claimed subject matter.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

That which is claimed:

1. A radiation source comprising:

a gas source;

a confinement tube coupled with the gas source and configured to contain a gas introduced into the confinement tube from the gas source;

a resonant inductor having a conductor shaped into coil disposed around the confinement tube, the coil comprising:

a first plurality of windings having a first diameter;

a second plurality of windings, each winding of the second plurality of windings having a diameter less than the first diameter; and a third plurality of windings having a third diameter; and switching circuitry electrically coupled with the resonant inductor that generates high current pulses within the coil of the resonant inductor, and switches the high current pulses at high frequencies.

2. The radiation source according to claim 1, wherein the resonant inductor is configured to ionize gas disposed within the confinement tube, generate a compact toroid within the ionized gas, and produce radiation from the compact toroid.

3. The radiation source according to claim 1, wherein the third diameter is substantially the same as the first diameter.

4. The radiation source according to claim 1, wherein the third diameter is less than the first diameter.

5. The radiation source according to claim 1, wherein the second plurality of windings have a diameter that varies among each winding of the second plurality of windings.

6. The radiation source according to claim 1, wherein the second plurality of windings have a conical or tapered shape.

7. The radiation source according to claim 1, further comprising an imaging chamber, wherein the resonant inductor is configured to direct compact toroids from the containment tube to the imaging chamber.

8. The radiation source according to claim 1, wherein the high frequencies comprise frequencies greater than 500 kHz.

9. The radiation source according to claim 1, wherein the high current pulse comprises current above 500 amps.

10. The radiation source according to claim 1, further comprising an outer inductor coil, wherein the confinement tube and the resonant inductor are disposed within the outer inductor coil.

11. The radiation source according to claim 10, wherein the outer inductor coil is configured to create a first bias magnetic field within the confinement tube, and wherein the resonant inductor is configured to create a second magnetic field within the confinement tube, wherein the second magnetic field has a polarity opposite the polarity of the first magnetic field.

12. A radiation source comprising:

a gas source;

a confinement tube coupled with the gas source and configured to contain a gas introduced into the confinement tube from the gas source;

a first resonant inductor wrapped around a portion of the confinement tube;

a second resonant inductor wrapped around a portion of the confinement tube; and a central resonant inductor wrapped around a portion of the confinement tube and disposed between the first resonant inductor and the second resonant inductor.

13. The radiation source according to claim 12, wherein the first resonant inductor has more windings than the central resonant inductor and the second resonant inductor has more windings than the central resonant inductor.

14. The radiation source according to claim 12, wherein the first resonant inductor and the second resonant inductor are disposed at opposite the ends of the confinement tube.

15. The radiation source according to claim 12, wherein the first resonant inductor and the second resonant inductor are configured to produce a magnetic field at the ends of the confinement tube greater than a magnetic field near the central portion of the confinement tube.

16. The radiation source according to claim 12, wherein the central resonant inductor has a tapered shape such that the diameter of the central resonant inductor is greater near the second resonant inductor and smaller near the first resonant inductor.

17. A method for creating ultraviolet light, the method comprising:

introducing a gas into a confinement chamber;

ionizing the gas within the confinement chamber;

generating a plurality of compact toroids in the ionized gas by pulsing high current and high frequencies within coils of a resonant inductor wrapped around the confinement chamber; and focusing ultraviolet radiation produced by each of the plurality of compact toroids toward a target or an intermediate focus.

18. The method according to claim 17, wherein the generating a plurality of compact toroids from the ionized gas using a resonant inductor further comprises:

generating a high current pulse within coils of the resonant inductor; and switching the high current pulse at high frequencies.

19. The method according to claim 18, wherein the high current comprises a current greater than 500 amps.

20. The method according to claim 18, wherein the high frequency comprises a frequency greater than 1 MHz.

* * * * *